US012589921B2

(12) United States Patent
Xie et al.

(10) Patent No.: US 12,589,921 B2
(45) Date of Patent: Mar. 31, 2026

(54) FOOD THERMOMETER STORAGE BOX

(71) Applicant: Shenzhen Yingboweiye Technology Co., Ltd, Shenzhen (CN)

(72) Inventors: Jinghua Xie, Shenzhen (CN); Zhiyong Fang, Shenzhen (CN)

(73) Assignee: Shenzhen Yingboweiye Technology Co., Ltd, Shenzhen (CN)

( * ) Notice: Subject to any disclaimer, the term of this patent is extended or adjusted under 35 U.S.C. 154(b) by 62 days.

(21) Appl. No.: 18/391,795

(22) Filed: Dec. 21, 2023

(65) Prior Publication Data

US 2025/0108963 A1 Apr. 3, 2025

(30) Foreign Application Priority Data

Sep. 28, 2023 (CN) ..... 202322673719.9

(51) Int. Cl.
*B65D 43/20* (2006.01)
*B65D 21/02* (2006.01)

(52) U.S. Cl.
CPC ..... *B65D 43/20* (2013.01); *B65D 21/0222* (2013.01); *B65D 2543/00796* (2013.01)

(58) Field of Classification Search
CPC ..... B65D 43/20; B65D 21/0222; B65D 2543/00796
USPC ..... 220/812
See application file for complete search history.

(56) References Cited

U.S. PATENT DOCUMENTS

2003/0185279 A1* 10/2003 Wu ..... G01K 5/12 374/E5.008
2009/0071502 A1* 3/2009 Drugeon ..... A45C 13/1069 132/293
2011/0132907 A1* 6/2011 Hajichristou ..... B65D 43/0225 215/337
2013/0037545 A1* 2/2013 Valley, III ..... B65D 43/20 220/345.2
2014/0084010 A1* 3/2014 Wan ..... A45D 33/006 220/525
2021/0281942 A1* 9/2021 Feng ..... H04R 1/1033

FOREIGN PATENT DOCUMENTS

KR 200436393 Y1 * 8/2007 ..... A45D 33/00
KR 200476106 Y1 * 1/2015 ..... A24F 15/14

* cited by examiner

*Primary Examiner* — Nathan J Jenness
*Assistant Examiner* — Eric C Baldrighi
(74) *Attorney, Agent, or Firm* — J. Peter Paredes; Amin Wasserman Gurnani LLP

(57) ABSTRACT

The present disclosure provides a food thermometer storage box, wherein the food thermometer storage box includes a box body and a lid body. The box body is provided with a storage groove, and the food thermometer can be placed in the storage groove. Additionally, the box body is provided with a first magnetic component. The lid body is slidably arranged on the box body, and the lid body is provided with a second magnetic component. When the lid body slides to close the storage groove, the first magnetic component is magnetically connected to the second magnetic component. The food thermometer storage box provided by the present disclosure can protect the entire food thermometer and is convenient for taking.

6 Claims, 5 Drawing Sheets

FOOD THERMOMETER STORAGE BOX

CROSS-REFERENCE TO RELATED APPLICATIONS

The present application claims priority to Chinese patent application No. 2023226737199, entitled "Food Thermometer Storage Box", filed to the China Patent Office on Sep. 28, 2023, the entire content of which is incorporated herein by reference.

TECHNICAL FIELD

The present disclosure relates to the field of storage boxes, and particularly to a food thermometer storage box.

BACKGROUND ART

With the widespread use of food thermometers, there is a variety of product appearances, and the ways of taking the probes have also become diversified. However, most of the probes on the market are directly exposed to the air, resulting in the probes being easily contaminated by the external environment, and the exposed probes can also easily scratch other items.

In the related technology, the storage box for food thermometers is usually a flip-cover box, which still has issues such as requiring a larger space when taking and storing and being inconvenient to operate.

SUMMARY

In view of this, the objective of the present disclosure is to overcome the shortcomings in the existing technology and provide a food thermometer storage box.

The present disclosure provides the following technical solution.

A food thermometer storage box comprises a box body, wherein the box body is provided with a storage groove, and a food thermometer can be placed in the storage groove; and the box body is provided with a first magnetic component; and a lid body, wherein the lid body is slidably arranged on the box body, and the lid body is provided with a second magnetic component; and when the lid body slides to close the storage groove, the first magnetic component is magnetically connected to the second magnetic component.

Furthermore, the sliding surface between the box body and the lid body is flat, or the sliding surface between the box body and the lid body is a curved surface. Additionally, the curved surface does not affect the relative sliding between the box body and the lid body.

Furthermore, one first magnetic component and one second magnetic component are provided as one set of magnetic connecting unit, and at least two sets of magnetic connecting units are provided.

Furthermore, a surface of the box body where the storage groove is located is provided with a first sliding component, and a surface of the lid body facing the storage groove is provided with a second sliding component; and the first sliding component and the second sliding component are slidably connected.

Furthermore, the first sliding component comprises a slide block, and the slide block is securely connected to the box body; the second sliding component on the lid body comprises a slide groove, and the slide groove is arranged on the lid body; and the slide block is slidably provided within the slide groove.

Furthermore, the box body is provided with at least one first sliding component, and a corresponding number of second sliding components are provided on the lid body.

Furthermore, the lid body comprises an upper cover and a middle frame. The middle frame is slidably arranged on the box body, and the upper cover is detachably connected to a side of the middle frame away from the box body.

Furthermore, the upper cover is provided with a first fastening part, and the middle frame is provided with a second fastening part. The first fastening part is snapped to the second fastening part.

Furthermore, a plurality of first fastening parts are arranged at intervals along the edge of the upper cover in a circumferential direction, a plurality of second fastening part are arranged at intervals along the edge of the middle frame in a corresponding circumferential direction, and one first fastening part is arranged oppositely to one second fastening part.

Furthermore, the slide groove is arranged on the middle frame and the slide block on the box body is slidably snapped in the slide groove.

Furthermore, the slide groove is a through groove; the slide block is provided with a guiding rib at a position where the slide block protrudes from the slide groove; and a side surface of the upper cover facing the middle frame is provided with a guiding rail, and the guiding rail can abut against the guiding rib.

Furthermore, each slide block is provided with two guiding ribs, and correspondingly, the upper cover is provided with two guiding rails.

Furthermore, in the embodiments of the present disclosure, the fixed connections on the box body and the lid body can be achieved by screws or dowel pins.

The embodiments of the present disclosure further provide a food temperature detection device, wherein the food temperature detection device comprises a food thermometer and the food thermometer storage box as described in the above embodiments. The food thermometer is placed inside the food thermometer storage box.

The embodiments of the present disclosure offer the following advantages.

The food thermometer storage box provided in the present disclosure comprises a box body and a lid body. A storage groove, for placing the food thermometer, is provided on the box body. A first magnetic component is arranged on the box body, and a second magnetic component is arranged on the lid body. The first magnetic component and the second magnetic component can be magnetically connected. The lid body and the box body is slidably connected. When the lid body is slid to close the storage groove, the first magnetic component is magnetically connected to the second magnetic component, thus containing the food thermometer within the food thermometer storage box. The food thermometer storage box provided in the embodiments allows for opening or closing of the box body by sliding cooperation between the lid body and the box body, i.e., using a sliding cover method to take the food thermometer. Once the food thermometer is placed inside the box body, the box body offers comprehensive protection to the food thermometer, thus preventing the probe from being exposed and scratching other objects or getting damaged by external elements. The design also makes the product convenient for carrying when traveling. Moreover, the sliding cover mechanism for taking and storage enhances the user's interactive experience with the product.

In order to make the above objective, features, and advantages of the present disclosure more obvious and easier to understand, the following is a better example, and with the attached drawings, for detailed description as follows.

BRIEF DESCRIPTION OF DRAWINGS

To more clearly illustrate the technical solutions of the embodiments of the present disclosure, the following will briefly introduce the drawings used in the embodiments. It should be understood that the following drawings only show some embodiments of the present disclosure, and therefore they should not be regarded as a limitation on the scope. Those ordinary skilled in the art can also obtain other related drawings based on these drawings without inventive effort.

REFERENCE NUMERALS

Figure 1:
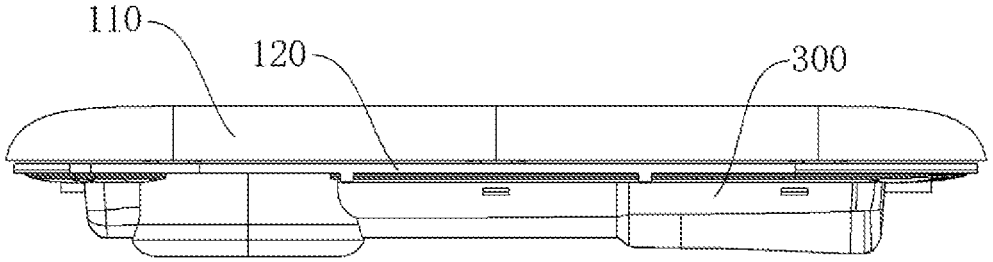
FIG. 1 is a structural schematic diagram at one view of a food thermometer storage box provided in an embodiment of the present disclosure.

100—lid body; 110—upper cover; 111—guiding rail; 120—middle frame; 121—slide groove; 200—first magnetic component; 201—first magnet; 202—first slot; 210—second magnetic component; 211—second magnet; 212—second slot; 300—box body; 310—storage groove; 320—slide block; 321—guiding rib; 330—screw.

DETAILED DESCRIPTION OF EMBODIMENTS

The following is a detailed description of an embodiment of the present disclosure, with examples shown in the drawings. Throughout the description, similar or identical reference numerals indicate corresponding or similar elements with the same or similar functions. The embodiments described below by reference to the drawings are exemplary and are intended only to explain the present disclosure and are not to be construed as a limitation of the present disclosure.

It should be clarified that when an element is described as being "fixed to" another element, it can be directly attached to the other element, or there can be an intermediary element. When an element is said to be "connected" to another element, it could be directly attached to the other element or may have an intermediary element. Conversely, when an element is described as being "directly on" another element, there is no intermediary element. The terms used herein, such as "vertical", "horizontal", "left", "right", and similar expressions, are used for explanatory purposes.

In the present disclosure, unless otherwise clearly stipulated and limited, the terms "mount", "link", "connect" and "fix" should be understood in a broad sense, for example, it can be a fixed connection, a detachable connection, or an integral connection, it can be a mechanical connection, an electrical connection, a direct connection, an indirect connection through an intermediary, an internal communication between two components, or the interaction relationship between two components. Those of ordinary skill in the art can understand the meanings of the above terms in the present disclosure according to specific situations.

Additionally, the terms "first" and "second" are used for descriptive objectives only and should not be understood as indicating or implying relative importance or specifying the quantity of the indicated technical features. Consequently, features labeled with "first" or "second" can explicitly or implicitly include one or more of those features. In the description of the present disclosure, the term "multiple (a plurality of)" means two or more, unless otherwise explicitly specified.

Unless otherwise defined, all technical and scientific terms used herein have the same meaning as commonly understood by one of ordinary skill in the technical field of the present disclosure. The terms used herein in the description are for the purpose of describing specific embodiments only and are not intended to limit the present disclosure. The term "or/and" as used herein includes any and all combinations of one or more related listed items.

Example 1

The embodiment of the present disclosure provides a food thermometer storage box primarily configured for storing food thermometers.

Figure 2:
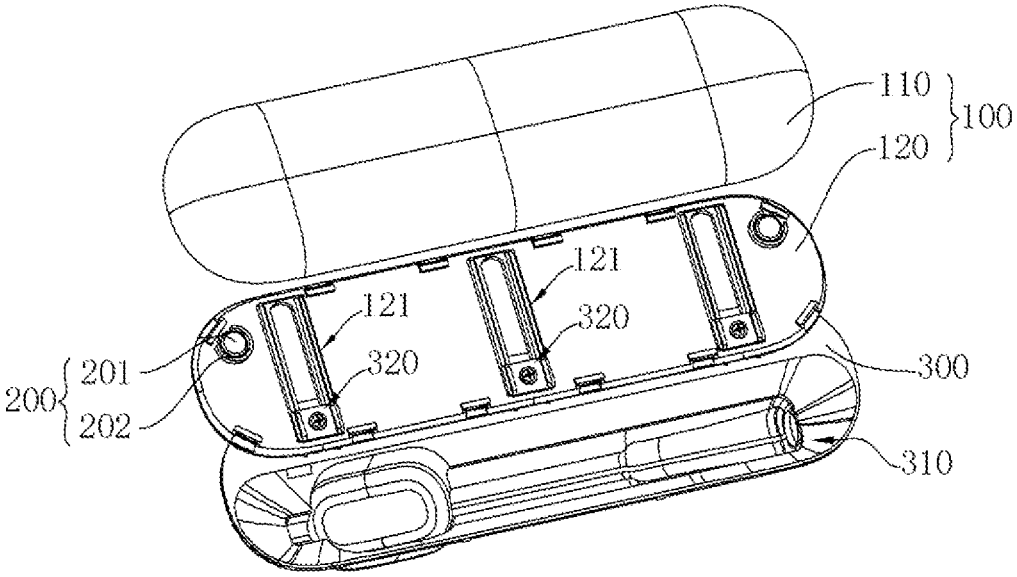
FIG. 2 is a first three-dimensional structural schematic diagram of the food thermometer storage box provided in an embodiment of the present disclosure.

As shown in FIGS. 1 and 2, the food thermometer storage box comprises a box body 300 and a lid body 100, wherein the box body 300 is provided with a storage groove 310, and a food thermometer can be placed in the storage groove 310; and the box body 300 is provided with a first magnetic component 200. The lid body 100 is slidably arranged on the box body 300, and the lid body 100 is provided with a second magnetic component 210.

When the lid body 100 is slid to close the storage groove 310, the first magnetic component 200 is magnetically connected to the second magnetic component 210.

Continuing to refer to FIGS. 1 and 2, when using the food thermometer storage box to store a food thermometer, it is only necessary to slide the box body 300 to stagger from the lid body 100, thus enabling the storage groove 310 on the box body 300 to be exposed. Then, the food thermometer is placed into the storage groove 310 on the box body 300. Afterward, the lid body 100 is slid until the storage groove 310 is completely covered to close the storage groove 310. At this point, the first magnetic component 200 on the box body 300 is magnetically connected to the second magnetic component 210 on the lid body 100. In the embodiment, the use of the first magnetic component 200 and the second magnetic component 210 not only makes the process of sliding and covering the lid body 100 onto the box body 300 smoother and more convenient but also ensures the reliable protection for the food thermometer by the box body 300 and the lid body 100 after the closing process is completed, so as to prevent the box body 300 and lid body 100 from unintentionally sliding due to external movement or vibration. Furthermore, a certain damping effect is added by the sliding covering method in combination with the first magnetic component 200 and the second magnetic component 210, thereby increasing the interest of the user in the product.

In one embodiment, optionally, the sliding surface between the box body 300 and the lid body 100 is a flat surface, thus ensuring a smooth sliding motion between the box body 300 and the lid body 100. Simultaneously, the flat surface reduces the gap between the contact surface of the lid body 100 and the contact surface of the box body 300, thereby making the lid body 100 seal the storage groove 310 more reliably. It can be understood that, in other embodiments, the sliding surface between the box body 300 and the lid body 100 can also be a curved surface, as long as it does not affect relative sliding between the box body 300 and the lid body 100.

In an embodiment, one first magnetic component 200, and one second magnetic component 210 are provided as one set of magnetic connecting unit, and at least two sets of magnetic connecting units are provided.

Figure 3:
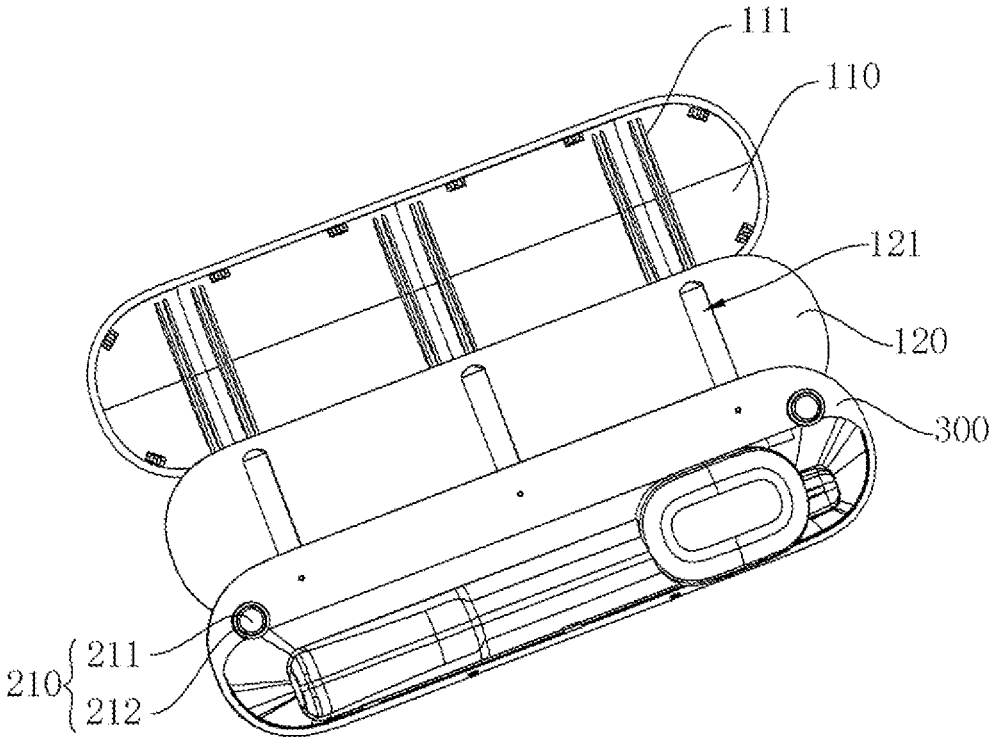
FIG. 3 is a second three-dimensional structural schematic diagram of the food thermometer storage box provided in an embodiment of the present disclosure.
Figure 4:
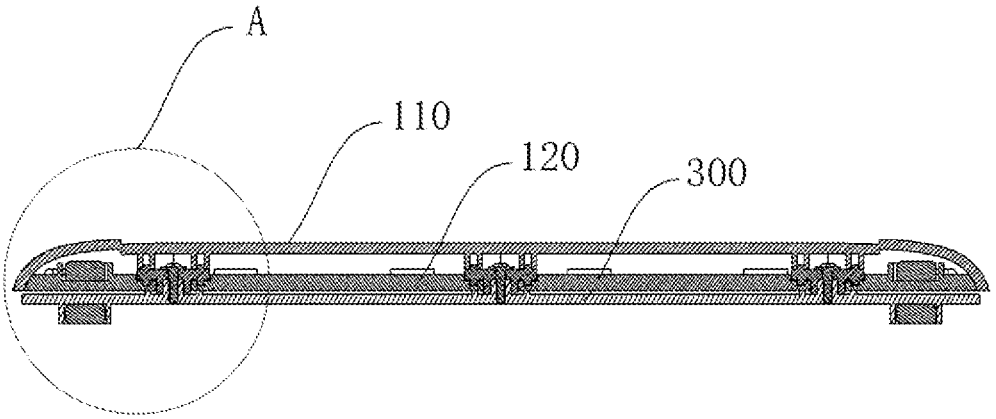
FIG. 4 is a structural schematic diagram of the food thermometer storage box in a closed state from one view provided in the embodiment of the present disclosure.
Figure 5:
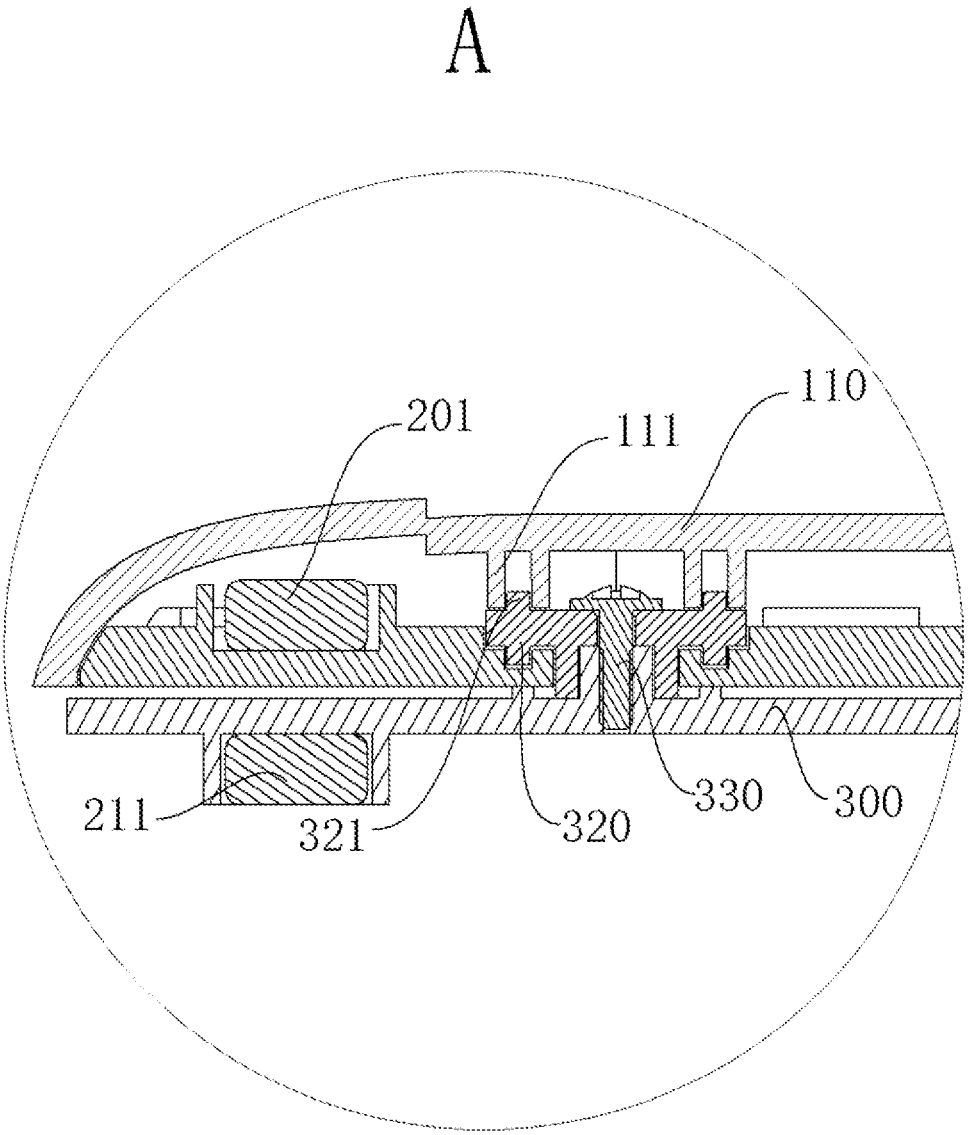
FIG. 5 is a partially enlarged view of part A from FIG. 4.

As shown in FIG. 2 to FIG. 3, illustratively, the lid body 100 is provided with two first slots 202 for snapping with the first magnetic component 200, and the two first slots 202 are arranged at both ends of the lid body 100. Both of the first slots 202 are therein snapped with a first magnet 201. On the box body 300, two second slots 212, configured for snapping with the second magnetic component 210, are also arranged at corresponding positions away from the side surfaces of the lid body 100. The second slot 212 is therein provided with a second magnet 211 that can be mutually attracted to the first magnet 201 on the lid body 100. One first magnet 201 and one second magnet 211 form one set of magnetic connecting unit, and two sets of magnetic connecting units are arranged on the box body 300 and lid body 100. When the box body 300 and the lid body 100 slide relative to each other, multiple first magnets 201 and multiple second magnets 211 produce suction forces or are separated at the same time, thus ensuring that the closing process of the box body 300 and the lid body 100 together is smooth. When the lid body 100 slides to a position where it can completely cover the storage groove 310 on the box body 300, the first magnet 201 on the box body 300 and the second magnet 211 on the lid body 100 can attract each other, thus ensuring the reliable closing of the box body 300 and lid body 100.

Of course, it can be understood that in other embodiments, three sets of magnetic connecting units, four sets of magnetic connecting units, or five sets of magnetic connecting units can also be arranged on the box body 300 and the lid body 100. For example, in FIG. 2, another set of magnetic connecting unit can be arranged at a position near the middle of the slide groove 121.

In an embodiment, furthermore, a surface of the box body 300 where the storage groove 310 is located is provided with a first sliding component, and a surface of the lid body 100 facing the storage groove 310 is provided with a second sliding component; and the first sliding component and the second sliding component are slidably connected.

As exemplarily shown in FIGS. 2 and 3, the first sliding component on the box body 300 comprises a slide block 320, wherein the slide block 320 is securely connected to the box body 300 and the slide block 320 is arranged at an edge of the surface of the box body 300 where the storage groove 310 is arranged. The second sliding component on the lid body 100 comprises a slide groove 121, wherein the slide groove 121 is arranged on the lid body 100, and the slide block 320 is slidably arranged in the slide groove 121. In the embodiment, the coordination between the slide block 320 and the slide groove 121 ensures smooth and stable sliding between the lid body 100 and the box body 300.

Exemplarily, the slide block 320 is a rectangular block, and two side edges of the slide block 320 abut against two sides of the slide groove 121, thereby ensuring reliable coordination between the slide block 320 and the slide groove 121. This prevents the slide block 320 from deviating during the sliding process, which affects coordination with the slide groove 121 and, consequently, the relative sliding between the box body 300 and the lid body 100.

It should be understood that the slide block 320 can have other shapes, such as a semi-circular structure, or a tenon-and-mortise structure designed for sliding between the slide block 320 and the slide groove 121.

In one embodiment, the box body 300 is provided with at least one first sliding component, and a corresponding number of second sliding components are provided on the lid body 100. Exemplarily, as shown in FIGS. 2 and 3, three slide blocks 320 are evenly distributed on the box body 300, and the lid body 100 is correspondingly provided with three slide grooves 121. Each slide block 320 is slidably arranged in the slide groove 121. Of course, in other embodiments, the slide block 320 can also be set as one, two, four, etc.

Example 2

Based on Example 1, the embodiment of the present disclosure has further improved certain structures.

In the embodiment of the present disclosure, the lid body 100 comprises an upper cover 110 and a middle frame 120; and the middle frame 120 is slidably arranged on the box body 300, and the upper cover 110 is detachably connected to a side of the middle frame 120 away from the box body 300. Specifically, the lid body 100 is divided into two parts: the upper cover 110 and the middle frame 120. On one hand, after dividing the lid body 100 into the upper cover 110 and the middle frame 120, the thickness of the middle frame 120 is thinner compared to the lid body 100. By arranging the first magnetic component 200 on the middle frame 120, the reliability of the magnetic connection between the first magnetic component 200 and the second magnetic component 210 can be improved. On the other hand, the sliding components that cooperate with the box body 300 can be arranged on the middle frame 120 and then protected by the upper cover 110, thereby making the present disclosure more durable and reliable.

Exemplarily, as shown in FIGS. 2 and 3, the upper cover 110 is provided with a first fastening part, and the middle frame 120 is provided with a second fastening part; and the first fastening part is snapped to the second fastening part, thus making the upper cover 110 and the middle frame 120 easy and quick to snap together and detach from each other.

Exemplarily, a plurality of first fastening parts are arranged at intervals along the edge of the upper cover 110 in a circumferential direction, and a plurality of second fastening part are arranged at intervals along the edge of the middle frame 120 in a corresponding circumferential direction. One first fastening part is arranged oppositely to one second fastening part. Therefore, the reliability of the connection between the upper cover 110 and the middle frame 120 is further improved.

In one embodiment, as shown in FIGS. 2 and 3, the slide groove 121 is arranged on the middle frame 120, and the slide block 320 on the box body 300 is slidably snapped into the slide groove 121. If the slide groove 121 is arranged on the lid body 100, the slide groove 121 needs to be provided as a blind groove to ensure the protection function of the storage groove 310. However, a blind groove will increase the difficulty of processing and installation. By arranging the slide groove 121 on the middle frame 120 and providing the slide groove 121 as a through groove, and then protecting the middle frame 120 and the slide groove 121 by snapping the separate upper cover 110 to the middle frame 120, the processing difficulty of the slide groove 121 is reduced and, consequently, the processing difficulty of the present disclosure is reduced. This also reduces the installation difficulty when installing the slide block 320 within the slide groove 121, thereby making the present disclosure more suitable for production and enhancing the practicality of the present disclosure.

In one embodiment, as shown in FIGS. 4 to 7, the slide groove 121 is a through groove; the slide block 320 is provided with a guiding rib 321 at a position where the slide block 320 protrudes from the slide groove 121; and a side surface of the upper cover 110 facing the middle frame 120 is provided with a guiding rail 111, and the guiding rail 111 can abut against the guiding rib 321. By placing the guiding rail 111 on the side surface of the upper cover 110, which coordinates with the guiding rib 321 on the slide block 320 that passes through the slide groove 121, it can be ensured that there is no friction between the slide block 320 and the upper cover 110 when the upper cover 110 and middle frame 120 slide relative to the box body 300. On the one hand, the upper cover 110 and the slide block 320 are protected to prevent damage by friction, and on the other hand, it is also ensured that the sliding process between the upper cover 110 and the box body 300 of the present embodiment is smooth, and there will be no lagging.

In one embodiment, the slide block 320 is a rectangular block, and the middle frame 120 is provided with a straight groove. The slide block 320, after passing through the slide groove 121, is arranged on the box body 300. The bottom surface of the slide block 320 is also provided with a guiding rib 321, and the guiding rib 321 inserts into the straight groove on the middle frame 120, thus enabling reliable coordination between the slide block 320 and the slide groove.

Exemplarily, the guiding rail 111 is two straight plates parallel to each other, the guiding rib 321 is an elongated protrusion, and the guiding rib 321 can be clamped between the two straight plates of the guiding rail 111.

Exemplarily, the guiding rib 321 on the upper and lower surfaces of the slide block 320 are symmetrically arranged, thus ensuring balanced forces on the slide block 320 during the sliding process and improving the stability of the sliding between the box body 300 and the lid body 100.

Exemplarily, two guiding ribs 321 are set on each slide block 320, and two guiding rails 111 are correspondingly arranged on the upper cover 110. This further ensures reliable support for the slide block 320 by the upper cover 110, and the cooperation of two guiding rails 111 and guiding ribs 321 reduces the risk of the guiding ribs 321 coming out of the guiding rails 111. Additionally, it helps to balance the forces on the upper cover 110, thereby preventing stress concentration and making the sliding more reliable.

It can be understood that in other embodiments, the upper cover 110 can also be provided with three guiding rails 111, four guiding rails 111, or five guiding rails 111. For example, in FIG. 3, another guiding rail 111 can be added on each side near the middle of the guiding rail.

In one embodiment, the upper cover 110 is an arched plate, and the protrusion on the arched plate faces away from the middle frame 120, further ensuring that the slide block 320 does not come into contact with the upper cover 110 during sliding.

Figure 6:
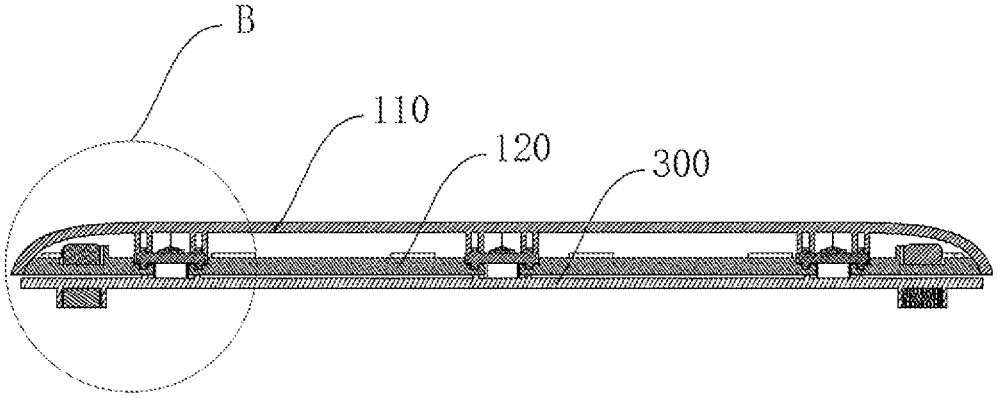
FIG. 6 is a structural schematic diagram of the food thermometer storage box in a sliding state from one view provided in the embodiment of the present disclosure.
Figure 7:
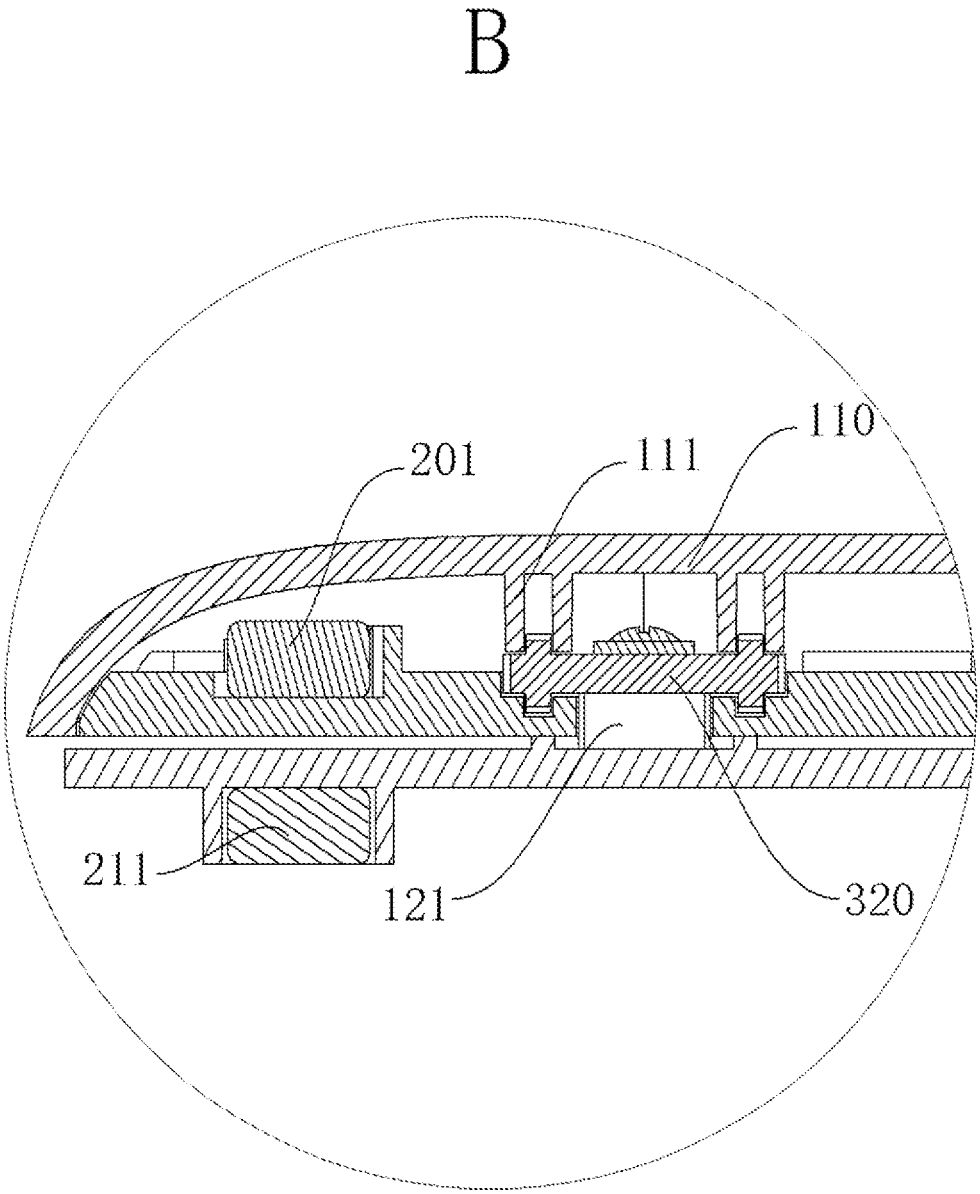
FIG. 7 is a partially enlarged view of part B from FIG. 6.

In one embodiment, as shown in FIGS. 6 and 7, the guiding rail 111 on the side surface of the upper cover 110 abuts against the guiding rib 321 on the slide block 320. Since the middle frame 120 can be detachably arranged on the upper cover 110, and the slide block 320 is arranged on the box body 300, when the guiding rail 111 on the upper cover 110 abuts against the guiding rib 321 on the slide block 320, the separation between the middle frame 120 and the box body 300 can be achieved by controlling the height of the guiding rail 111 and guiding rib 321. This further ensures smooth and natural sliding between the box body 300 and the middle frame 120.

Exemplarily, three slide grooves 121 are evenly arranged on the middle frame 120, and each slide groove 121 can be therein provided with a slide block 320 that can slide within it. Two guiding rails 111 are provided on the side surfaces of the upper cover 110 at positions corresponding to each slide block 320.

In one embodiment, both the box body 300 and the lid body 100 can be fixed by screws 330 or dowel pins. For example, during the arrangement of the slide block 320, it is first inserted into the slide groove 121 on the middle frame 120 and then fixed to the box body 300 by screws 330 or dowel pins passing through the slide groove 121 along the direction of the middle frame 120. For instance, the upper cover 110 and the middle frame 120 can also be fixed by screws 330 or dowel pins instead of the first fastening part and the second fastening part. This makes the installation process convenient, and make it easy to dismantle. Therefore, in the event of bumps, breakage, and other accidental situations that require maintenance, it is easy to dismantle and replace the parts.

Example 3

The present disclosure provides a food temperature detection device, comprising a food thermometer and a food thermometer storage box. The food thermometer storage box comprises a box body 300 and a lid body 100. The box body 300 is provided with a storage groove 310, and the food thermometer can be placed in the storage groove 310. The box body 300 is provided with a first magnetic component 200. The lid body 100 is slidably arranged on the box body 300, and the lid body 100 is provided with a second magnetic component 210. When the lid body 100 slides to close the storage groove 310, the first magnetic component 200 is magnetically connected to the second magnetic component 210. The food temperature detection device provided in the embodiment comprises the food thermometer storage box from any of the embodiments described above. Therefore, it possesses all the advantageous effects of the food thermometer storage box in any of the above embodiments, which are not repeated here.

In all examples shown and described herein any specific value should be construed as illustrative only and not as a limitation. Thus, other examples of exemplary embodiments may have different values.

It should be noted that similar numerals and letters denote similar terms in the following drawings so that once an item is defined in one drawing, it does not need to be further discussed in subsequent drawings.

The above-mentioned embodiments only express several implementation modes of the present disclosure, and the descriptions thereof are relatively specific and detailed, but should not be construed as limiting the patent scope of the present disclosure. It should be pointed out that those skilled in the art may make several modifications and improvements without departing from the concept of the present disclosure, and these all belong to the protection scope of the present disclosure.

What is claimed is:

1. A food thermometer storage box, comprising:

a box body, wherein the box body is provided with a storage groove, and a food thermometer can be placed in the storage groove; and the box body is provided with at least one first magnetic component; and a lid body, wherein the lid body is slidably arranged on the box body, and the lid body is provided with at least one second magnetic component; and when the lid body slides to close the storage groove, the at least one first magnetic component is magnetically connected to the at least one second magnetic component, wherein the lid body is provided with at least one first slot for snapping with the at least one first magnetic component, the at least one first slot is therein snapped with at least one first magnet, on the box body, at least one second slot, configured for snapping with the at least one second magnetic component, is arranged at a corresponding position away from a side surface of the lid body, the at least one second slot is therein provided with at least one second magnet that is mutually attracted to the at least one first magnet on the lid body, a surface of the box body where the storage groove is located is provided with a first sliding component, and a surface of the lid body facing the storage groove is provided with a second sliding component; and the first sliding component and the second sliding component are slidably connected;

the lid body comprises an upper cover and a middle frame; and the middle frame is slidably arranged on the box body, and the upper cover is detachably connected to a side of the middle frame away from the box body;

the first sliding component comprises a slide block, and the slide block is securely connected to the box body; the second sliding component comprises a slide groove, and the slide groove is arranged on the middle frame; and the slide block is slidably snapped within the slide groove;

the slide groove is a through groove; the slide block is provided with a first guiding rib at a position where the slide block protrudes from the slide groove; and a side of the upper cover facing the middle frame is provided with a guiding rail, and the guiding rail is able to abut against the first guiding rib;

the slide block is a rectangular block, and the middle frame is provided with a straight groove, the slide block, after passing through the slide groove, is arranged on the box body, a bottom surface of the slide block is provided with a second guiding rib, and the second guiding rib inserts into the straight groove on the middle frame; and the guiding rail is two straight plates parallel to each other, the first guiding rib is an elongated protrusion, and the first guiding rib is able be clamped between the two straight plates of the guiding rail.

2. The food thermometer storage box according to claim 1, wherein a sliding surface between the box body and the lid body is flat;

or a sliding surface between the box body and the lid body is a curved surface.

3. The food thermometer storage box according to claim 1, wherein one first magnetic component and one second magnetic component are provided as one set of magnetic connecting unit, and at least two sets of magnetic connecting units are provided.

4. The food thermometer storage box according to claim 1, wherein the upper cover is provided with a first fastening part, and the middle frame is provided with a second fastening part; and the first fastening part is snapped to the second fastening part.

5. The food thermometer storage box according to claim 4, wherein a plurality of first fastening parts are arranged at intervals along an edge of the upper cover in a circumferential direction, a plurality of second fastening parts are arranged at intervals along an edge of the middle frame in a circumferential direction, and one first fastening part is arranged oppositely to one second fastening part.

6. A food temperature detection device, comprising a food thermometer and the food thermometer storage box according to claim 1, wherein the food thermometer is placed inside the food thermometer storage box.

* * * * *